US007364484B2

(12) United States Patent
Sanger, II

(10) Patent No.: US 7,364,484 B2
(45) Date of Patent: Apr. 29, 2008

(54) TOY AIRBOAT

(76) Inventor: Robert E. Sanger, II, 2703 Buckingham Ave., Lakeland, FL (US) 33803

( * ) Notice: Subject to any disclaimer, the term of this patent is extended or adjusted under 35 U.S.C. 154(b) by 0 days.

(21) Appl. No.: 11/356,794

(22) Filed: Feb. 17, 2006

(65) Prior Publication Data

US 2007/0197108 A1 Aug. 23, 2007

(51) Int. Cl.
*B63H 7/00* (2006.01)

(52) U.S. Cl. ..... 440/37

(58) Field of Classification Search ..... 440/37
See application file for complete search history.

(56) References Cited

U.S. PATENT DOCUMENTS

| | | | | |
|---|---|---|---|---|
| 2,612,129 | A | 9/1952 | Burch | |
| 3,413,948 | A * | 12/1968 | Coll | 114/287 |
| 3,559,222 | A * | 2/1971 | Walker | 114/357 |
| 3,589,058 | A | 6/1971 | Labat | |
| 3,938,458 | A | 2/1976 | Irgens | |
| 4,015,555 | A | 4/1977 | Tinkham | |
| 4,165,703 | A | 8/1979 | Burg | |
| 4,180,882 | A | 1/1980 | Kawasaki | |
| 4,351,262 | A | 9/1982 | Matthews | |
| 4,392,445 | A | 7/1983 | Burg | |
| 4,458,622 | A | 7/1984 | Anderson | |
| 4,480,579 | A | 11/1984 | Masters | |
| 4,494,477 | A | 1/1985 | Matthews | |
| 4,587,918 | A | 5/1986 | Burg | |
| 4,715,311 | A | 12/1987 | Masters | |
| 4,739,719 | A | 4/1988 | Burg | |
| 4,890,564 | A | 1/1990 | Burg | |
| 4,998,898 | A | 3/1991 | Dufrene | |
| 5,000,107 | A | 3/1991 | Burg | |
| 5,082,465 | A | 1/1992 | Wine | |
| 5,110,311 | A | 5/1992 | Wilkerson | |
| D329,476 | S | 9/1992 | Strickland et al. | |
| D329,886 | S | 9/1992 | Fujitani | |
| 5,176,095 | A | 1/1993 | Burg | |
| 5,713,293 | A * | 2/1998 | Shiffler et al. | 114/61.27 |
| 5,807,149 | A | 9/1998 | Kaye | |
| 5,839,926 | A | 11/1998 | Kaye | |
| 5,860,383 | A | 1/1999 | Whitener | |
| 6,022,261 | A | 2/2000 | Zhu et al. | |

(Continued)

*Primary Examiner*—Jesús D Sotelo
(74) *Attorney, Agent, or Firm*—Beusse Wolter Sanks Mora + Maire, P.A.; David G. Maire

(57) ABSTRACT

A toy airboat (10) having a negative trim element (38) and an adjustable positive trim element (44) for selectively controlling the performance of the craft in varying environmental conditions such as wind speeds and wave heights. The negative trim element may be smoothly curved protrusions (40) formed integral to the hull (12) in order to avoid snagging debris in water and to allow operation over land without damage to the hull. The protrusions may be symmetrically located on opposed sides of a centerline (CL) of the craft approximately midway between the centerline and a perimeter (16) of the hull. The adjustable positive trim element may be a bolt (46) threaded into a nut (48) affixed to a deck (14) of the craft. The nut extends to make contact with the hull to impart a desired degree of convex curvature to the otherwise generally flat bottom of the hull. The bolt may be attached to the hull with a push/pull mechanism (54) to allow the nut alternatively to impart a desired degree of concave curvature to the hull.

11 Claims, 4 Drawing Sheets

U.S. PATENT DOCUMENTS 6,056,608 A * 5/2000 Phelan, Sr. ..... 440/37
D427,562 S 7/2000 Phelan
6,364,723 B1 4/2002 Hite
6,684,807 B1 * 2/2004 Smith ..... 114/285
6,865,869 B2 3/2005 Penny
7,055,451 B2 * 6/2006 Kalil ..... 114/290

* cited by examiner

TOY AIRBOAT

FIELD OF THE INVENTION

This invention relates generally to the field of toy watercraft, and particularly to toy airboats.

BACKGROUND OF THE INVENTION

Radio controlled toy boats are well known in the hobby industry. Toy boat designs typically mimic full size boat designs, including V-hull inboard and outboard boats, tunnel hulls boats, "cigar" racing boats, and air cushion hover craft vehicles.

It is well known to adjust the trim angle of a boat to regulate its ride and performance. The terms trim and trim angle refer to the horizontal pitch of the boat relative to the horizontal surface of the water. Many devices are known for adjusting trim angle, for example U.S. Pat. No. 4,458,622 describes a full size boat having a variable hull configuration, and U.S. Pat. No. 3,589,058 describes a toy boat having an adjustable stabilizing weight system.

Airboats, also known as swamp boats, are specially designed craft having aircraft style propeller or fan propulsion and a flat bottom for operation in very shallow water, weed-infested water, and over land or mud. While the flat bottom design is useful for relatively low speeds in multi-terrain environments, such as swamps, it has the disadvantage of being relatively unstable at high speeds and especially in high-speed turns. Airboats are also susceptible to degraded performance under adverse environmental conditions such as high wind or high waves.

BRIEF DESCRIPTION OF THE DRAWINGS

The invention is explained in following description in view of the drawings that show.

DETAILED DESCRIPTION OF THE INVENTION

In spite of the similarity of the designs of toy boats and full size boats, the performance of toy boats can be significantly different than their full size counterparts due to the importance of scaling factors. For example, the power-to-weight ratio in a toy boat may be significantly higher than in its full size counterpart, and environmental conditions such as wind speed and wave height may have a proportionately greater affect on a toy boat. Full size airboats are generally constructed of metal or are reinforced with metal and are relatively heavy vehicles with a modest power-to-weight ratio, such as 0.1 horsepower/pound in one example. Toy airboats may be made of plastic and may have a much higher power-to-weight ratio, such as 0.3 horsepower/pound in one example. As a result, toy airboats can reach speeds of over 40 miles per hour, which may equate to a scale speed of several hundreds of miles per hour in a full size airboat. Furthermore, small fluctuations in wave height and wind speed have a proportionately much greater impact on the performance of a toy airboat than on a full size airboat due to the toy's small size and light weight.

Figure 1:
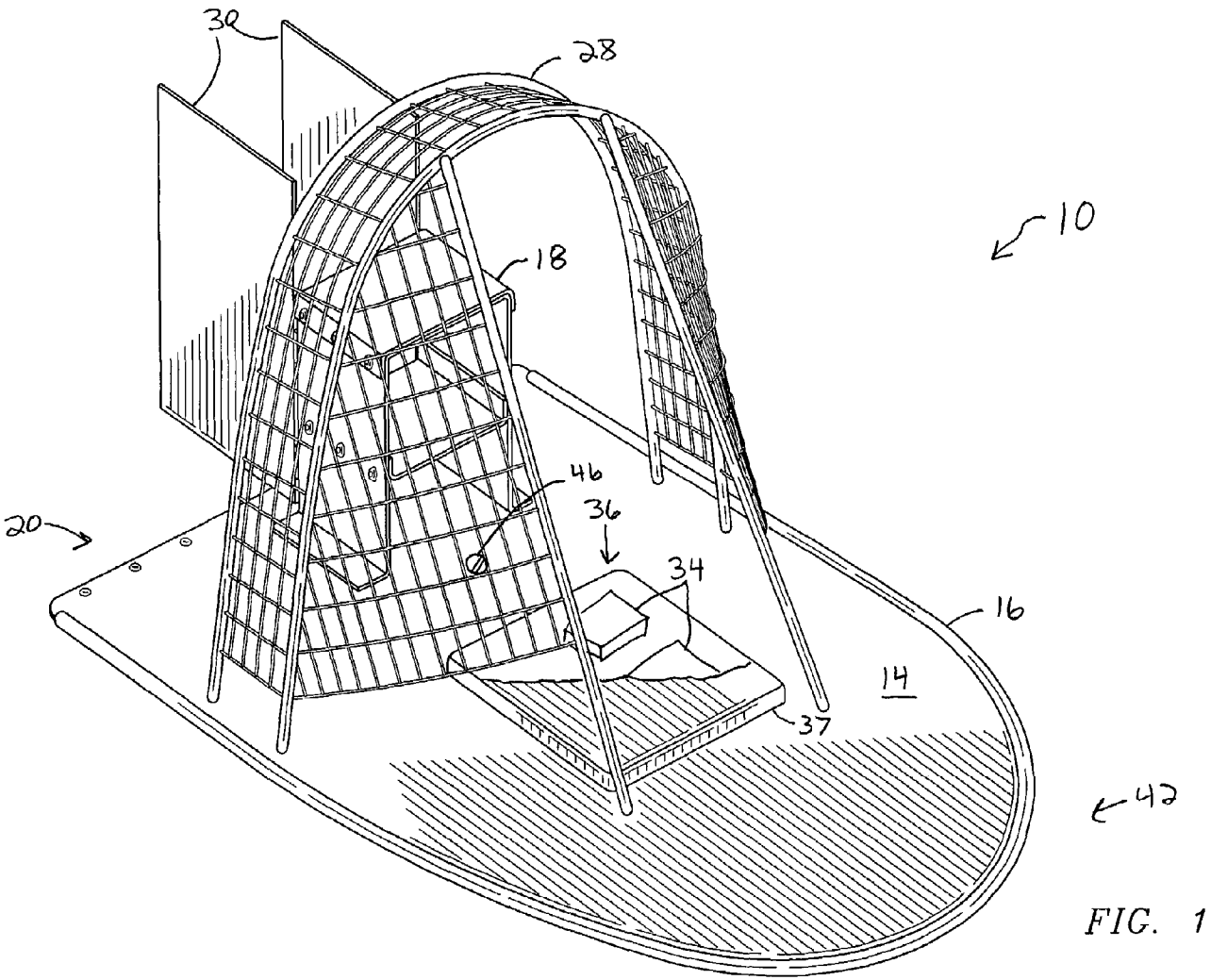
FIG. 1 is a perspective view of one embodiment of a toy airboat incorporating the present invention and illustrated without an engine.
Figure 2:
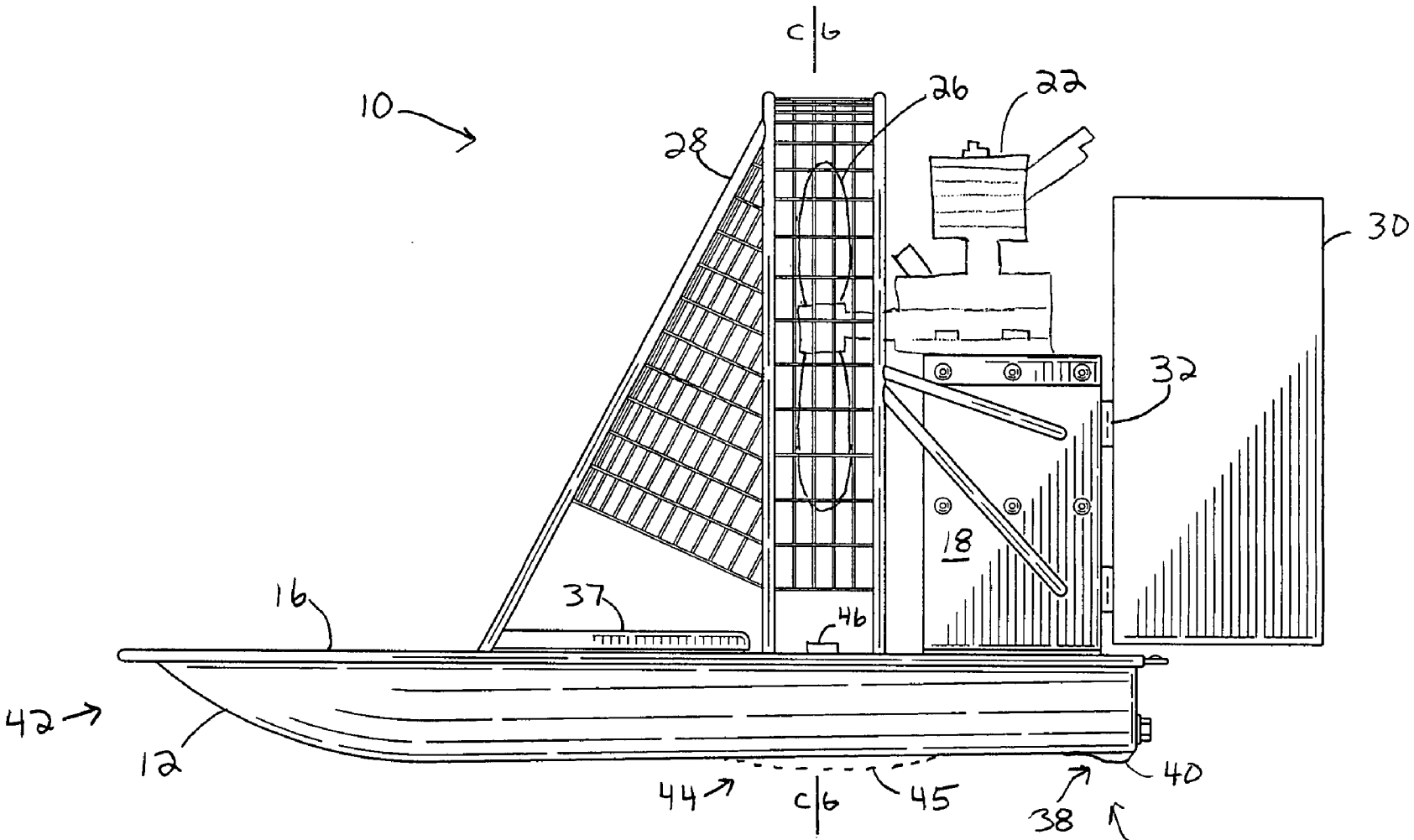
FIG. 2 is a side view of the airboat of FIG. 1 including its engine and illustrating positive and negative trim elements in the hull.
Figure 3:
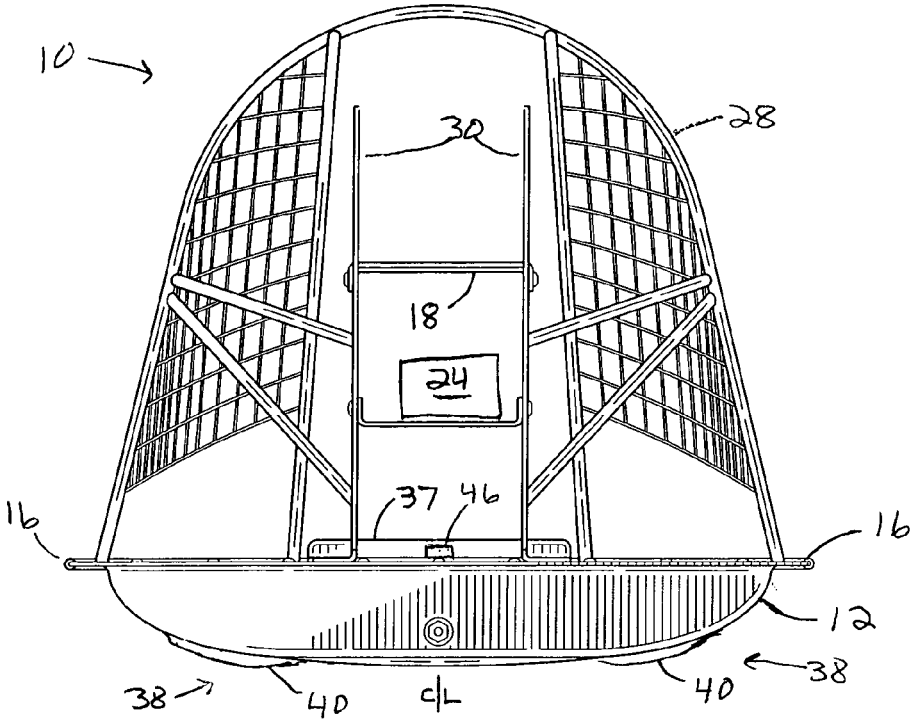
FIG. 3 is a rear view of the airboat of FIG. 1 illustrating the negative trim element.

Toy airboat 10 of FIGS. 1-3 includes innovative features that provide improved performance by addressing both the unique design aspects of airboats generally and the significant scaling factors that limit the performance of prior art toy airboats. Airboat 10 includes hull 12, which may be made of a vacuum formed plastic and reinforced with a lightweight foam resin in selected areas, for example. In many regards, the hull 12 is similar to that of a full size airboat, with important exceptions to be discussed more fully below. A deck 14 is sealed to the hull 12 about its perimeter 16 to define a trapped airspace providing floatation for the craft. An engine stand 18 is attached to the deck 14 proximate the stern 20 of the airboat 10. A model aircraft engine 22 (illustrated as installed only in FIG. 2, with the craft shown without engine in FIGS. 1 and 3) as known in the art may be mounted to the engine stand 18. The engine stand 18 also provides a location below the engine 22 for mounting of a fuel tank 24 (shown only in FIG. 3) for gas-powered engines. The propeller 26 of the engine 22 is surrounded by a protective cage 28, which may be formed of a wire mesh and tube steel in order to provide safe operation with minimal weight and air drag. Other embodiments may utilize a different type of propulsion, such as a ducted fan engine that may not require a separate protective cage 28. At least one air rudder 30 is attached to the engine stand 18 by hinges 32. The airboat 10 is controlled remotely with a radio control system 34 as is known in the hobby arts. Remote control of both the rudder 30 and the engine 22 are provided to allow an operator to control both the direction and speed of the craft. The radio control system 34 components are housed in a compartment 36 having a removable watertight lid 37 (illustrated as being clear plastic) providing access to the radio control system 34. When two air rudders 30 are used, they may be connected together to be controlled by a single servo-actuator of the radio control system 34.

The hull 12 of the airboat 10 is illustrated in the side view of FIG. 2 and the rear view of FIG. 3. The hull 12 includes a negative trim element 38 located proximate the stern 20 of the craft. In the illustrated embodiment, the negative trim element 38 is integrally formed into the hull 12 as two separate protrusions 40 extending somewhat below the plane of a main body of the bottom of the hull, as may be appreciated by viewing both FIGS. 2 and 3. In this embodiment, the negative trim element 38 provides fixed amount of negative trim for the craft. Other embodiments may have the negative trim element being formed separately from the hull, such as when using external, remotely adjustable trim tabs for providing a variable amount of negative trim to the craft. Advantageously, the illustrated trim element 38 has a generally smooth surface shape that provides the desired lifting force while minimizing drag and allowing the airboat 10 to operate in water without snagging debris and on land without damage to the hull 12. The negative trim element 38 provides a fixed amount of negative trim during operation of the airboat 10, i.e. it constantly urges the stern 20 of the craft upward and the bow 42 of the craft downward. Negative trim is necessary for preventing the bow 42 of airboat 10 from bouncing excessively at high speeds or under high wave or high headwind conditions.

Negative trim element 38 may be purposefully designed to provide more negative trim than is necessary for optimal operation of the airboat 10. With too much negative trim, the toy airboat 10 would plow through the water, creating a large wake, and reducing its speed and maneuverability. To counteract this excessive amount of negative trim, an adjustable positive trim element 44 is provided to allow the curvature of the generally flat bottom of the hull 12 forward of the negative trim element 38 to be selectively changed, and in particular, to be selectively displaced into a convex shape. FIG. 2 illustrates the generally flat bottom of the hull in two alternative conditions: a flat condition illustrated with a solid line and a more convex shape illustrated with dashed line 45. As illustrated, the term convex is used herein to describe the condition where a portion of the generally flat hull 12 is bowed downward away from the deck 14 beyond its generally flat planar position. The term concave is used herein to describe the condition where a portion of the generally flat hull 12 is bowed upward toward the deck 14 beyond its generally flat planar position. The amount of positive trim imposed by the positive trim element 44 during operation of the airboat 10 is generally proportional to the degree of convex curvature imposed on the hull 12. By providing an adjustable degree of positive trim, the balance between the positive and negative trim imposed by the positive trim element 44 and the negative trim element 38, respectively, may be selected and controlled by the user to provide optimal performance under a wide range of boat configurations and environmental conditions. For example, as wave heights and/or wind conditions increase, a more negative balance between the trim elements may be selected to provide increased stability and protection against excessive bouncing and loss of control or flip-over of the craft. When wave heights and/or wind conditions decrease, a less negative balance between the trim elements may be selected to provide smoother operation and to maximize speed. Such control is very advantageous for a toy airboat 10, since even small changes in environmental conditions can have a very large affect on the performance of the craft, and because the operator of the craft will want to maximize the craft speed under a variety of conditions. Adjustment of the trim balance may also be desired when making changes to the airboat 10, such as when placing accessories on-board that may change the center of gravity (CG) of the craft.

Figure 4:
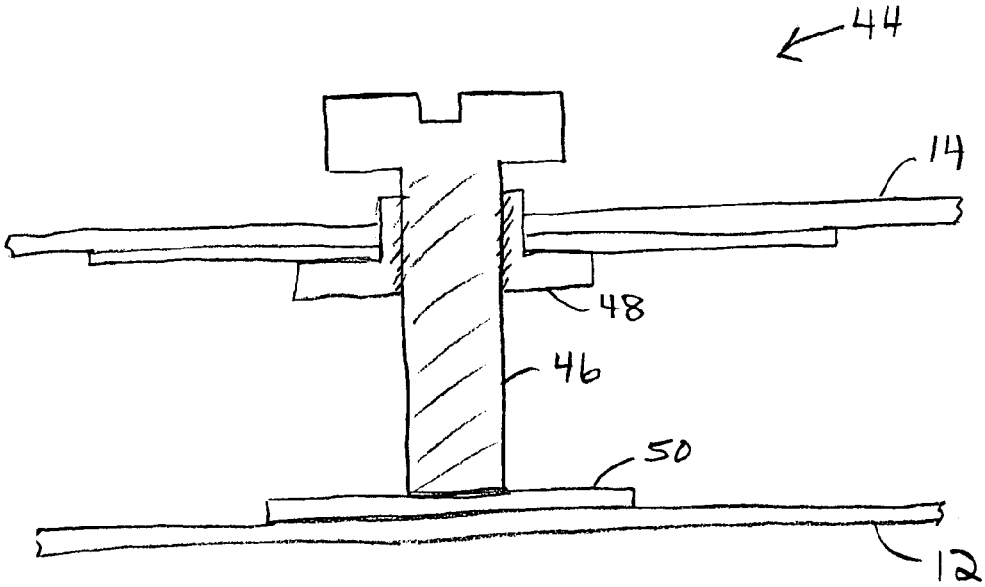
FIG. 4 is a partial cross-sectional view of the airboat of FIG. 1 illustrating the adjustable positive trim element.

FIG. 4 illustrates one embodiment of the adjustable positive trim element 44 mounted between the hull 12 and the deck 14. A threaded bolt 46 is adjustably engaged with a threaded nut 48, such as a T-nut, attached to the deck 14. When the bolt 46 is screwed into the nut 48, it engages the hull 12 directly or indirectly through a protective reinforcing structure 50 attached to the hull 12. As the bolt 46 is advanced farther into the nut 48, it applies force against the hull 12 and functions to impart a selectively increasing convex shape to the hull 12. The position of the positive trim element 44 in the hull 12 is forward of the negative trim element 38 and preferably along a centerline (CL) of the craft parallel to its direction of movement through the water. In one embodiment, the positive trim element 44 is located proximate the location of the center of gravity of the craft along the centerline. The operator of the airboat 10 manipulates the adjustable positive trim element 44 of FIG. 4 manually by turning bolt 46 with a screwdriver or wrench. Other embodiments of positive trim elements may allow for remote adjustment of the degree of positive trim during operation of the craft via the radio control system 34.

The design of the negative trim element 38 may vary for various applications. In the embodiment of FIG. 3, the two protrusions 40 are symmetrically located about the centerline of the craft and are each somewhat inboard from the perimeter 16 of the hull 12, such as approximately centered between the centerline and the respective portion of the hull perimeter 16. This arrangement maintains a negative trim effect even when the airboat 10 tilts during turns, thereby ensuring positive control even during high speed turns. While tilting of a full size airboat is undesirable because of the danger of tipping, it is quite desirable in a toy airboat 10 because it generates excitement for the operator and allows for a maximum speed of operation. By placing the protrusions 40 closer to the perimeter 16 of the hull 12, they would function to reduce the amount of slide and bounce during a turn, which provides somewhat more control but also may give the toy craft a less exciting and less realistic performance.

Note that the size of the protrusions 40 and the magnitude of the convex shape imposed by the positive trim element 44 are somewhat exaggerated in the figures for purposes of illustration. In one embodiment, a toy airboat 10 of the present invention has an overall hull length of about 26 inches, a full hull depth of about 2 inches, is powered by a 0.46 cubic inch 2-cycle gas model airplane engine that generates about 2.2 horsepower at full throttle, weighs about 8 pounds, and can achieve smooth water speeds of about 40 miles per hour. For that particular embodiment, the present inventor has successfully used smoothly curved negative trim protrusions 40 that extend only about 0.25 inch below the plane of the main body of the bottom of the hull with a positive trim element that provides up to a maximum of about 0.25 inch of convex displacement as measured from the generally flat plane of the bottom of the hull to the point of maximum downward displacement.

Figure 5:
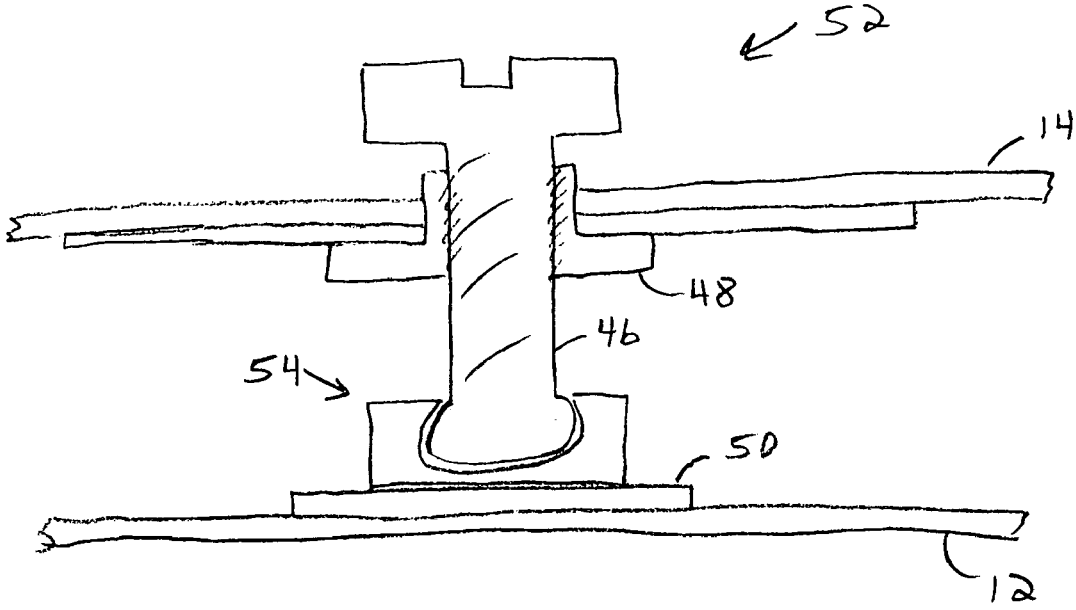
FIG. 5 is a partial cross-sectional view of another embodiment of a toy airboat illustrating an adjustable positive/negative trim element.

FIG. 5 illustrates an adjustable positive/negative trim element 52 that may be used in lieu of the adjustable positive trim element 44 in other embodiments. The adjustable positive/negative trim element 52 includes many of the same structures as the adjustable positive trim element 44, and such structures are numbered consistently between FIGS. 4 and 5. The key difference between these two figures is that the bolt 46 is connected to the hull 12 by a push/pull mechanism 54 that allows the bolt 46 to impart both pushing and pulling forces on the hull 12 to create either a positive (convex) or a negative (concave) trim effect. The push/pull mechanism 54 is illustrated in FIG. 5 as a ball and socket arrangement, although other mechanisms may be used. This embodiment allows a toy airboat to be configured with less fixed negative trim in the negative trim element 38 while still being able to accommodate the most extreme conditions. Even when a positive/negative trim element 52 is used, it is still desirable to include a negative trim element 38 in order to provide improved control during high speed turns as discussed above.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A toy airboat comprising:

a hull comprising a generally flat bottom between a bow and a stern and comprising a negative trim element proximate the stern;

an engine for propelling the hull;

an air rudder for steering the hull;

a remote control system allowing an operator remotely to control a speed of the engine and a position of the air rudder; and an adjustable positive trim element for selectively displacing a portion of the generally flat bottom into a convex shape;

wherein the adjustable positive trim element comprises:

a nut supported by a deck of the airboat; and a bolt engaged with the nut and extending to make contact with the hull for displacing the hull into an increasingly convex shape as the bolt is threaded increasingly into the nut in a direction toward the hull.

2. The toy airboat of claim 1, further comprising a push-pull mechanism interconnecting the bolt and the hull for displacing the hull into a concave shape as the bolt is threaded outwardly from the nut in a direction away from the hull.

3. A toy airboat comprising:

a hull comprising a generally flat bottom between a bow and a stern;

a negative trim element disposed proximate the stern; and an adjustable trim element disposed between the negative trim element and the bow;

wherein the adjustable trim element comprises an adjustable positive trim element for selectively displacing the generally flat bottom into an increasingly convex shape;

wherein the adjustable trim element further comprises an element selectively extendable by an adjustable length toward the generally flat bottom to make contact with the generally flat bottom such that a change in length of extension of the element results in a corresponding change in the shape of the generally flat bottom.

4. The toy airboat of claim 3, wherein the negative trim element comprises a pair of protrusions formed in the hull on respective opposed sides of a centerline of the hull.

5. The toy airboat of claim 4, wherein each protrusion is disposed approximately midway between the centerline and a respective portion of a perimeter of the hull.

6. The toy airboat of claim 3, further comprising:

a nut attached to a deck of the airboat; and the selectively extendable element comprises a bolt threaded through the nut, such that turning of the bolt in the nut results in a change in the shape of the generally flat bottom.

7. The toy airboat of claim 3, wherein the adjustable trim element comprises a remotely controlled element allowing for remote adjustment of a degree of positive trim during operation of the toy airboat via a radio control system.

8. A toy airboat comprising:

a hull comprising a generally flat bottom between a bow and a stern;

a negative trim element disposed proximate the stern; and an adjustable trim element disposed between the negative trim element and the bow;

wherein the adjustable trim element comprises:

a nut supported by a deck of the airboat; and a bolt engaged with the nut and extending to make contact with the hull for displacing the hull into an increasingly convex shape as the bolt is threaded into the nut in a direction toward the hull.

9. The toy airboat of claim 8, further comprising a push-pull mechanism interconnecting the bolt and the hull for displacing the hull into a concave shape as the bolt is threaded outwardly from the nut in a direction away from the hull.

10. The toy airboat of claim 8, further comprising:

an engine for propelling the hull;

an air rudder for steering the hull;

a remote control system allowing an operator remotely to control a speed of the engine and a position of the air rudder.

11. A toy airboat comprising:

a hull comprising a generally flat bottom between a bow and a stern;

a negative trim element disposed proximate the stern; and an adjustable trim element disposed between the negative trim element and the bow;

wherein the adjustable trim element comprises an adjustable positive/negative trim element for selectively alternatively displacing the generally flat bottom into one of a convex or concave shape;

wherein the adjustable trim element further comprises a selectively extendable element extending from a deck of the airboat and connected to the generally flat bottom such that a change in a degree of extension of the element below the deck results in a corresponding displacement of the generally flat bottom.

* * * * *